US005353210A

United States Patent [19]

Strok et al.

[11] Patent Number: 5,353,210

[45] Date of Patent: Oct. 4, 1994

[54] REFLECTOR LAMP WITH LOW UV EMISSION

[75] Inventors: Jack M. Strok, Garrettsville; Thomas G. Parham, Gates Mills; Curtis E. Scott, Mentor, all of Ohio

[73] Assignee: General Electric Company, Schenectady, N.Y.

[21] Appl. No.: 936,157

[22] Filed: Aug. 27, 1992

Related U.S. Application Data

[63] Continuation-in-part of Ser. No. 419,233, Oct. 10, 1989, Pat. No. 5,143,445, and a continuation-in-part of Ser. No. 669,820, Mar. 15, 1991, abandoned.

[51] Int. Cl.[5] ..... F21V 9/00

[52] U.S. Cl. ..... 362/293; 362/343

[58] Field of Search ..... 362/293, 263, 343

[56] References Cited

U.S. PATENT DOCUMENTS 4,714,986 12/1987 Wurster ..... 362/263

5,130,904 7/1992 Ohshio et al. ..... 362/293 X

*Primary Examiner*—Stephen F. Husar

*Attorney, Agent, or Firm*—Stanley C. Corwin; George E. Hawranko

[57] ABSTRACT

Reflector lamps having vitreous, light transmissive reflectors and containing a source of visible and UV light radiation produce little or no UV radiation in the projected light beam by having a light reflecting coating on the exterior surface of the reflector and the reflector made of UV absorbing glass or having a UV absorbing coating disposed between the light reflecting coating and the exterior reflector surface. An anti-reflecting coating disposed on the interior, light-receiving surface of the reflector reduces UV emission still further.

3 Claims, 5 Drawing Sheets

REFLECTOR LAMP WITH LOW UV EMISSION

CROSS-REFERENCE TO RELATED APPLICATIONS

This application is a continuation-in-part application of co-pending U.S. application Ser. No. 07/419,233 filed on Oct. 10, 1989, now U.S. Pat. No. 5,143,445 and 07/669,820 filed on Mar. 15, 1991, now abandoned.

BACKGROUND OF THE INVENTION

1. Field of the Invention

This invention relates to a reflector lamp having low UV emission by means of a UV-absorbing material between the UV source and light-reflecting surface. More particularly, this invention relates to a reflector lamp comprising a vitreous, light-transparent reflector having a visible light-reflecting coating on its outer surface and containing a source of visible and UV light within, wherein the UV is absorbed by (i) the reflector, (ii) the light-reflecting coating, (iii) a coating disposed between the reflector and light-reflecting coating or any combination thereof.

2. Background of the Disclosure

Almost all arc discharge lamps and many high intensity filament lamps, such as tungsten-halogen lamps, emit ultraviolet (UV) radiation which is harmful to human eyes and skin and which also causes fading, discoloration and degradation of fabrics, plastics and paints. In automotive, general illumination and display types of lighting applications, lamps are almost always used mounted in forward, light-projecting reflectors having an interior light-reflecting surface for reflecting the light emitted by the lamp and projecting the reflected light forward of the reflector in the desired beam pattern. The most common type of reflector and lamp combination is the parabolic reflector (PAR) in which a lamp is mounted inside a reflector having a metallized, interior light reflecting surface, with the central portion of the lamp light source at the focal point of the reflector. A light opaque coating on, or a light shield disposed over, the forward end of the lamp ensures that all of the radiation emitted by the lamp is reflected forward of the reflector. Because the UV radiation emitted by high intensity arc discharge lamps and some high intensity filament lamps is harmful to humans, to materials and to the general environment, a need exists for reducing and preferably eliminating the UV emission. One such method is to employ a lens over the forward, light projecting end of the reflector with a UV-absorbing coating on the interior surface of the lens. This is costly and isn't always practical or desirable.

SUMMARY OF THE INVENTION

This invention relates to a vitreous, light-transmissive reflector having light-reflecting means on the outer surface of the reflector and means for absorbing UV radiation between the source of the UV radiation and the said light reflecting means. The UV-absorbing means comprises (i) the reflector, (ii) the light-reflecting means, (iii) a UV-absorbing coating disposed between the outer surface of the reflector and light-reflecting means or combination thereof. In one embodiment the invention relates to a lamp and reflector assembly or combination employing a lamp which emits both UV and visible light radiation mounted within the reflector, with a light-reflecting means on the outer surface of the light-reflecting portion of the reflector and a UV-absorbing means disposed between the light-reflecting means and the lamp. Lamp and reflector combinations according to the invention can be made wherein substantially none of the UV radiation emitted by the lamp is projected forward of the reflector without the need for a UV-absorbing means (such as a coated lens) on the open, visible light projecting forward end of the reflector. In this embodiment a light opaque coating or light shield will be present at the forward end of the lamp to insure that all of the light radiation emitted by the lamp is reflected from the light-reflecting means, with the emitted UV radiation being absorbed by the UV-absorbing means.

DETAILED DESCRIPTION

By vitreous, light-transparent reflector is meant glass or a glassy material including a soda lime glass and harder or high temperature glasses such borosilicate and aluminosilicate glasses, including Pyrex, and also high purity silica glasses such as Vycor and fused quartz having an $SiO_2$ content of at least 96–99 wt. % made from natural quartz sand and synthetic silica. By UV-absorbing means is meant the vitreous reflector itself, (UV-absorbing glasses and fused quartz being known to those skilled in the art) or a UV-absorbing coating disposed on the outer surface of the light-reflecting portion of the reflector which, in one embodiment, can include the light-reflecting means or coating. In this embodiment the light-reflecting coating disposed on the outer surface of the reflector will, of itself, absorb UV radiation.

By UV radiation is meant radiation having a wavelength generally below about 380–400 nm. UV radiation having a wavelength of about 260 nm or less is known as "hard" or short wave UV and can produce ozone as well as degrade materials. UV radiation between 260–320 nm is detrimental to humans and plastics and UV radiation having a wavelength of from about 320 to about 380–400 nm produces skin discoloration. UV radiation also degrades various dyes, colors and pigments found in fabrics and materials present in displays. Accordingly, a reflector according to the invention should absorb UV radiation having a wavelength up to at least about 340 nm and, preferably 380–400 nm and below and, at the same time, be substantially non-absorbent and transparent to visible light radiation. By light-reflecting means is meant a metallic light-reflecting coating, such as aluminum, or a multilayer optical interference coating.

Figure 1:
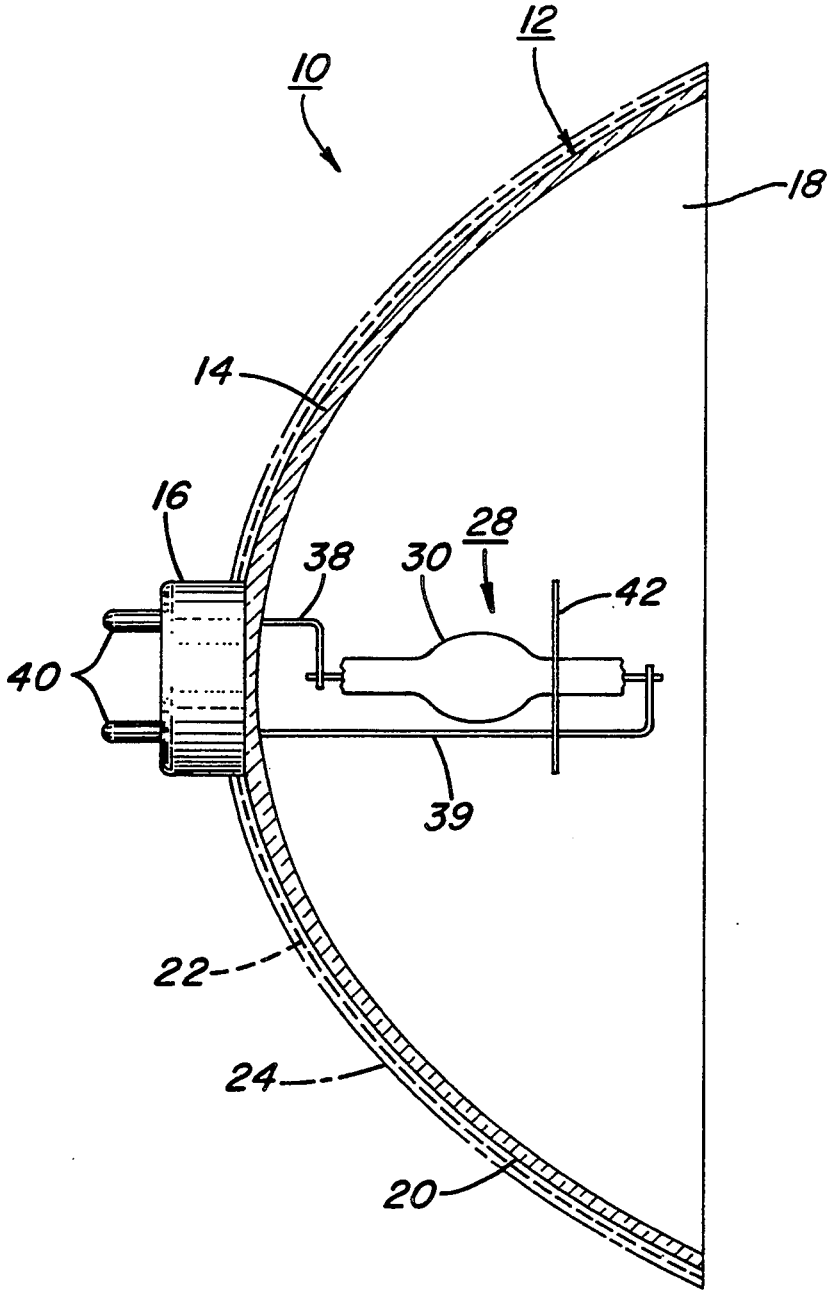
FIG. 1 schematically illustrates an arc discharge lamp and a UV-absorbing glass reflector assembly useful in the practice of the present invention, with a light-reflective coating on the outer surface of the reflector.

Turning to FIG. 1 there is schematically shown an embodiment of an arc discharge lamp and reflector assembly 10 according to the invention comprising a vitreous, light transparent reflector 12 made of glass or fused quartz consisting of a parabolic or elliptical reflecting portion 14, open at its forward projecting end 18 and terminating at its rear end in a plastic or ceramic base portion 16. The exterior surface 20 of reflector 12 is coated with a thin (i.e. 0.8 micron) UV absorbing coating of zinc oxide (ZnO) 22 over which is disposed a light-reflecting coating of aluminum 24 which reflects visible light radiation. Coating 22 is clear and substantially transparent and non-absorbing to radiation in the visible light region, but absorbs radiation in the UV region (i.e., below about 380 nm). The forward end 18 of reflector 12 may, if desired, be sealed with a lens (not shown). Lamp 28 is a miniature, metal halide arc discharge lamp which emits both visible and UV light radiation and is enclosed within reflector 12 with its optical center approximately coinciding with the focal point of reflector 12. Lamp 28 comprises a fused quartz envelope 30 enclosing within a pair of hermetically sealed electrodes (not shown) as is well known to those skilled in the art. Lamp 28 also contains a small amount of mercury, along with one or more metal halides and an inert starting gas, such as xenon and is connected by means of mount wires 38 and 39 to base portion 16 (by means not shown) and thence to terminal pins 40 for connection to a source of electric current. Such lamps and their construction are known to those skilled in the art. In this embodiment, a blackened metal light shield 42 shaped like a washer is shown pressed onto the tubular portion at the forward end of the lamp to insure that all of the light radiation emitted by the lamp and projected forward of the reflector is reflected from reflecting surface 24. If desired the light shield may be welded or mechanically fastened to mount wire 39. Metal light shields and their uses with lamps are known to those skilled in the art.

Figure 2:
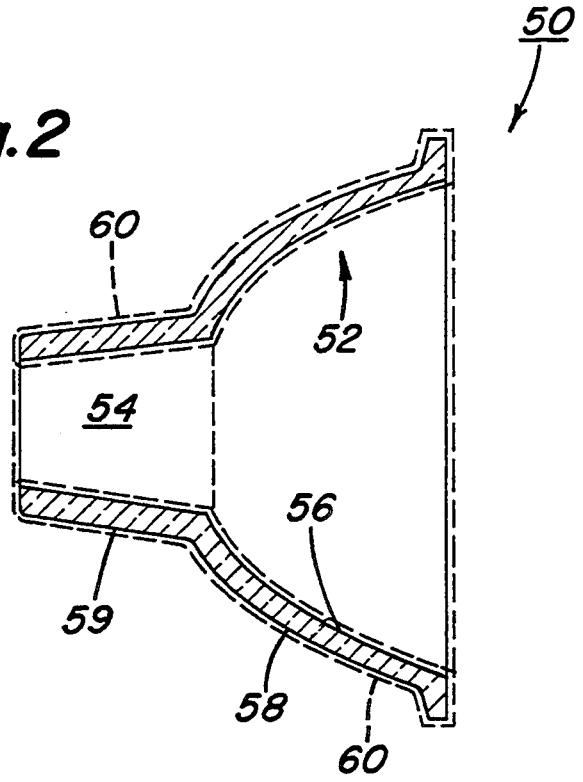
FIG. 2 schematically illustrates a UV-absorbing glass reflector having a light-reflecting coating only on its exterior surface.
Figure 3:
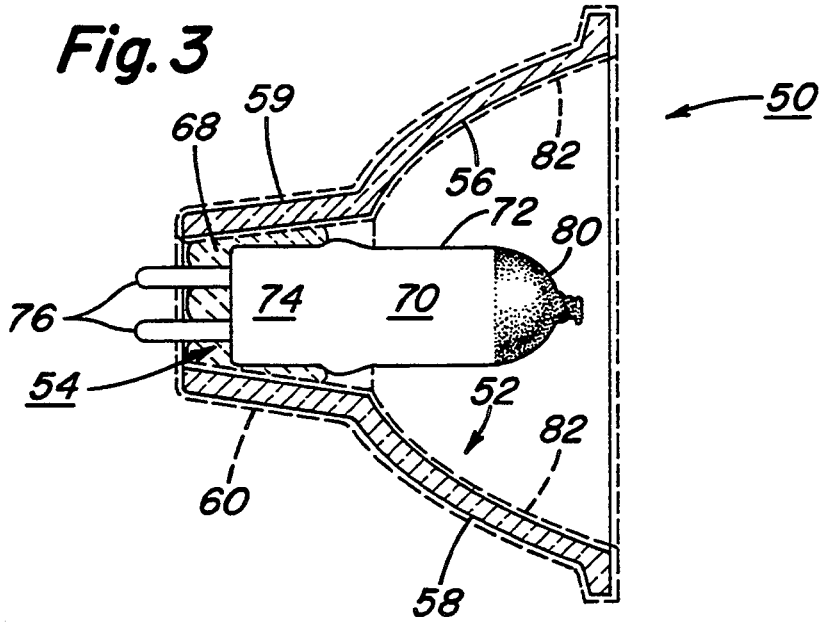
FIG. 3 schematically illustrates a reflector and lamp combination in accordance with the present invention in which a UV absorbing coating is disposed between the reflective coating and the glass reflector.

Turning now to FIG. 2, there is schematically shown a side view of an all-glass reflector 50 made of UV-absorbing glass or fused quartz having a visible light-reflecting coating only on its outer surface in accordance with one embodiment of the present invention. Thus, UV-absorbing, glass or fused quartz reflector 50 comprising front reflecting portion 52 and rearwardly protruding cavity 54 is coated only on its outer surface 58 with a visible light-reflecting coating 60. Thus, there is no light-reflecting coating on the inner, light-receiving surface 56 of reflector 50. In the embodiment shown, the light-reflecting coating 60 is applied over the entire outer surface of the glass reflector which includes the exterior surface 58 of the forward reflecting portion as well as the exterior surface 59 of the rearwardly projecting nose portion. In some embodiments this will be preferred to prevent light from escaping out the nose portion or cavity of the reflector during operation of the lamp. However, light-reflecting coating 60 may be disposed only on the outer surface 58 of the reflecting portion 52 of the reflector. Turning now to FIG. 3, there is schematically illustrated lamp 70 comprising a vitreous envelope 72 hermetically sealed at 74 by means of a customary pinch seal and having exterior leads 66. The lamp is cemented into cavity 54 by cement 68. In the embodiment illustrated in FIG. 3, a black, light opaque coating 80 is shown at the upper portion of lamp 70 to ensure that all of the light emitted by the lamp and projected forward of the reflector has passed through the UV-absorbing glass or fused quartz reflector 50 and reflected forward off visible light-reflecting coating or film 60. Thus, in this embodiment, all the light projected forward from the lamp and reflector lamp assembly is essentially free of UV radiation. Finally, in a preferred embodiment, an anti-reflective coating 82 is disposed on the light-receiving surface 56 of the reflecting portion. The presence of an anti-reflective coating further reduces the amount of forward-projected UV radiation as will be explained below. Lamp and reflector combinations of this general construction, but having a UV and visible light-reflecting coating or film only on the interior reflector surface are known to those skilled in the art as are suitable cements for securing the lamp in the reflector. U.S. Pat. No. 4,833,576, the disclosures of which are incorporated herein by reference, discloses such lamp and reflector combinations and cements suitable for cementing the lamp in the reflector which are useful in the practice of the present invention. Lamp 70 also contains inert gas, metal halide, a filament and in-leads or an arc (not shown) within envelope 72.

As set forth above, a reflector according to the invention will be a vitreous, light-transparent material and, in at least one embodiment, will also be a UV-absorbing material. The vitreous, light-transparent reflector may be made of soda lime glass or, in the case of miniature and/or high intensity lamp and reflector combinations, a high temperature glass, a high silica content material such as Vycor, or a high purity fused quartz glass made by fusing natural or synthetic silica having a purity of at least 99 wt. % $SiO_2$. UV absorbing glasses and high purity silica or fused quartz materials are known to those skilled in the art. Thus, U.S. Pat. No. 4,361,779 discloses a lamp having a quartz glass vessel containing ceria or europia as the UV-absorbing dopants. Russian Patent Document 44I246 discloses a high purity fused quartz containing europia and titania as UV-absorbing dopants, along with minor amounts of alumina. U.S. Pat. No. 4,307,315 discloses an arc discharge lamp fabricated from a quartz glass containing europia. Russian Patent Document 391074 discloses a high temperature, aluminosilicate glass containing europia, cesia and ceria. U.S. Pat. No. 3,148,300 discloses a lower temperature glass, such as a soda-lime glass composition, which may contain ceria, titania and vanadia as UV-absorbing dopants. This list is meant to be illustrative, but non-limiting with respect to the practice of the present invention. As those skilled in the art will know, the choice of high or low temperature glass or high purity silica and the UV-absorbing dopants are left to the discretion of those skilled in the art and are determined by the particular UV-absorbance and operating temperatures required by the reflector.

Coatings and materials which absorb UV radiation, but which transmit visible light radiation are also known to those skilled in the art and in the practice of the present invention may include those commercially available and obtained from coating manufacturers and suppliers such as the Silicone Division (GE Silicones) of GE Plastics in Waterford, N.Y., Dow Corning, DuPont, Bee Chemical Company and the like. Heat-resistant coatings are preferred for use in the present invention, and illustrative but non-limiting examples of both coatings and UV absorbers based on heat-resistant silicone compounds suitable for use in the present invention are disclosed and claimed, for example in U.S. Pat. Nos. 4,374,674; 4,278,804; 3,986,997; etc., the disclosures of which are incorporated herein by reference. Another UV-absorbent coating material suitable for use in the present invention is zinc oxide (ZnO) and is disclosed in U.S. Pat. No. 4,006,378, the disclosures of which are also incorporated herein by reference. Zinc oxide may also be employed as a pigment material in an ordinary coating or in a higher temperature resistant silicone coating alone, or combined with titanium dioxide, depending upon the application. Such a coating material is disclosed in U.S. Pat. No. 5,051,650, the disclosure of which is incorporated herein by reference. In yet another embodiment, the visible light reflecting coating or film applied to the outer surface of the reflector may be a coating which, in addition to reflecting visible light, also inherently absorbs UV radiation, such as some types (i.e., titania-silica and tantala-silica) of multi-layer, optical interference coatings.

The visible light-reflecting coating employed in the practice of the invention may be metallic (i.e., aluminum, silver, gold, platinum and the like) or it may be a multilayer optical interference coating or film. Suitable, visible light-reflecting, multilayer, optical interference coatings are known to those skilled in the art and comprises alternating layers of high and low index of refraction materials including, for example, zinc sulfide-silica; titania-silica; tantala-silica; niobia-silica, etc. These coatings may be applied by vacuum sputtering (U.S. Pat. No. 4,663,557), from solutions (U.S. Pat. Nos. 4,634,919 and 4,701,663) and by CVD or LPCVD (U.S. Pat. Nos. 4,949,005 and 4,775,203). As mentioned above, some of these coatings such as tantala-silica and titania-silica, also absorb UV radiation. These multilayer coatings may be designed to reflect visible light radiation and heat (hot mirror) or reflect visible light radiation and transmit heat or infrared radiation (cold mirror), both types or designs being suitable for use with the present invention.

Figure 4:
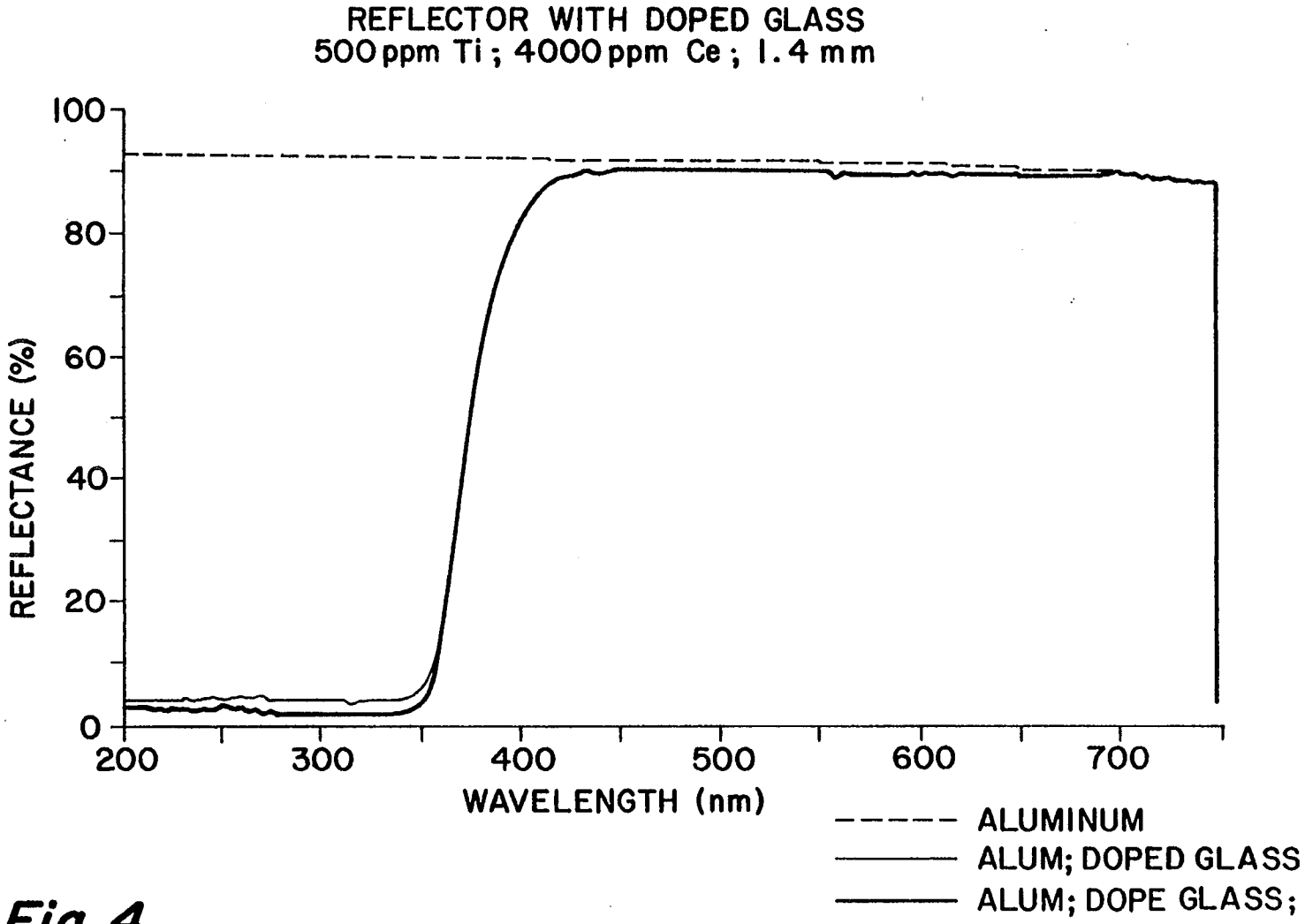
FIG. 4 illustrates reflectance as a function of wavelength for a UV absorbing glass reflector according to the invention.

FIG. 4 is a plot of percent reflectance calculated as a function of wavelength in nanometers for a glass or fused quartz reflector 1.4 mm thick and doped with titania and ceria as UV absorbing dopants, with an aluminum light-reflecting layer on the outside surface of the reflector. The dashed line at the top of the graph illustrates the reflectance of a bright aluminum surface for comparison. Two embodiments are shown; one with an anti-reflection layer on the interior light-receiving surface of the reflector and one without the anti-reflection layer. The anti-reflection layer is 0.055 microns of magnesium fluoride ($MgF_2$). The amount of titanium and cerium present in the UV absorbing glass or fused quartz is 500 wppm and 4000 wppm, respectively, and the undoped glass has no inherent UV absorbance of its own. The tremendous reduction in reflected UV projected forward of the reflector is immediately apparent using the UV-absorbing glass reflector with an aluminum light reflecting coating on its outside surface. Although the further reduction in UV reflectance with the anti-reflection layer is not as spectacular, it does provide a substantial further reduction of about half compared to the same reflector with no anti-reflection layer.

Figure 5:
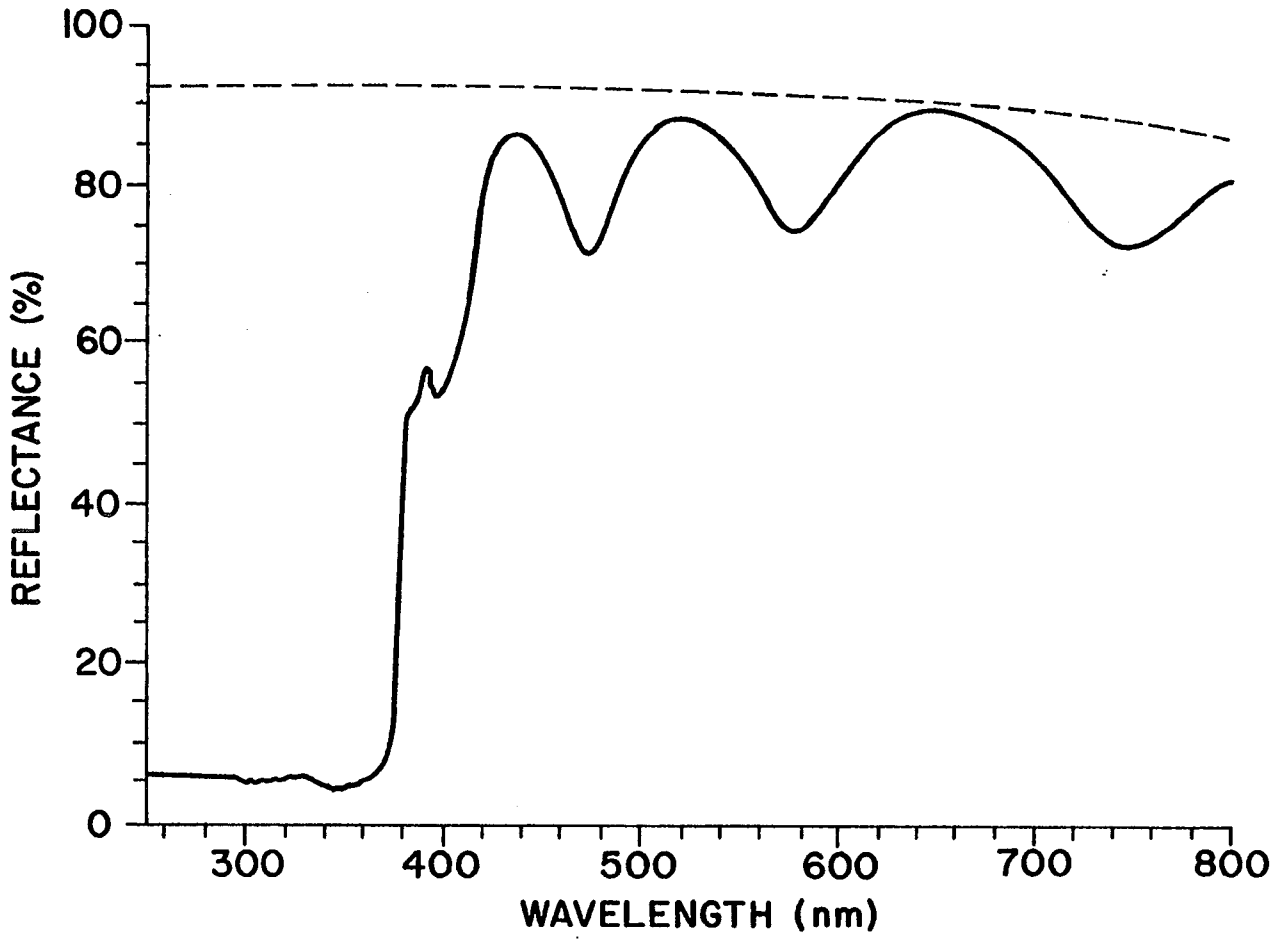
FIG. 5 illustrates reflectance for a reflector according to the invention having a zinc oxide coating for absorbing UV radiation.

FIG. 5 is also a graph of percent reflectance as a function of wavelength calculated for a reflector of a type shown in FIG. 1 wherein the glass or fused quartz is assumed to have no UV absorbance, but with a layer of zinc oxide 0.8 microns thick between the outer reflector surface and the aluminum reflecting layer. Again, the theoretical reflectance of aluminum is provided as a reference point. In this embodiment the UV absorbing edge is sharper and close to about 380 nm.

Figure 6:
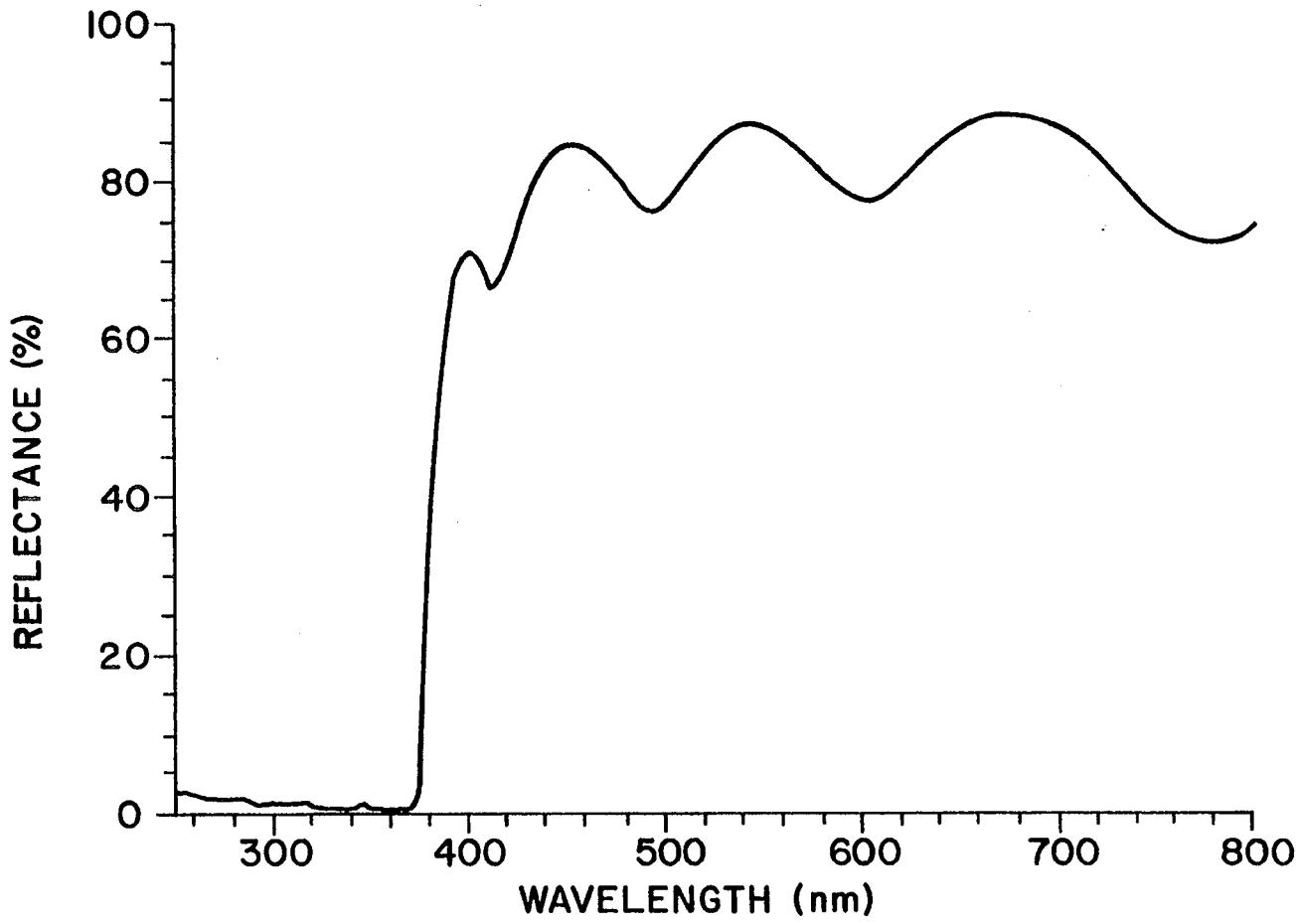
FIGS. 6 illustrates reflectance for a reflector similar to that of FIG. 5, but with an anti-reflective coating on the light-receiving surface of the reflector.

FIG. 6 is for a similar reflector, but with the addition of an anti-reflecting layer of magnesium fluoride ($MgF_2$) 0.055 microns thick on the interior, light-receiving surface of the reflector. The difference is very noticeable, with the addition of the anti-reflection layer resulting in virtually no reflection of the UV below 380 nm being projected forward into the light beam. In both of these cases, the glass was assumed to be completely transparent to both visible and UV light radiation.

While particular embodiments of the invention have been shown and described, it will be obvious to those skilled in the art that various changes and modifications may be made without departure from the invention in its broader aspects; and it is, therefore, intended herein to cover all such changes and modifications as fall within the true spirit and scope of the invention.

What is claimed is:

1. A reflector lamp comprising a vitreous, light-transmissive reflector having a visible light-reflecting coating on its exterior surface and containing a source of visible and UV light radiation within, wherein said emitted UV radiation is absorbed by (i) said reflector, (ii) said light-reflecting coating, (iii) a UV absorbing coating disposed between said light-reflecting coating and said exterior reflector surface, or combination thereof.

2. A lamp of claim 1 further having an anti-reflection coating on the interior, light-receiving surface of said reflector.

3. A lamp of claim 1 wherein said light-reflecting coating transmits infrared radiation.

* * * * *